US005367953A

United States Patent [19]

Yamashita et al.

[11] Patent Number: 5,367,953

[45] Date of Patent: Nov. 29, 1994

[54] ROLLER OFFSET PRINTING APPARATUS

[75] Inventors: Kenkichi Yamashita; Hideaki Oyanagi, both of Kanagawa, Japan

[73] Assignee: NSK Ltd., Tokyo, Japan

[21] Appl. No.: 84,581

[22] Filed: Jul. 1, 1993

[30] Foreign Application Priority Data

Jul. 1, 1992 [JP] Japan ..... 4-197796

[51] Int. Cl.[5] ..... B41F 3/36

[52] U.S. Cl. ..... 101/158; 101/163; 101/DIG. 36; 33/619

[58] Field of Search ..... 101/33, 41, 93, 146, 101/158, 164, 186, 215, 250, 251, 481, 485, 486, DIG. 36, 163; 33/614, 617, 619, 620, 623

[56] References Cited

U.S. PATENT DOCUMENTS

| | | | |
|---|---|---|---|
| 1,430,059 | 9/1922 | Deeks | 101/186 |
| 3,067,676 | 12/1962 | Dickerson | 101/158 |
| 3,101,050 | 8/1963 | Schaefer et al. | 101/186 |
| 3,336,865 | 8/1967 | Brand | 101/158 |
| 4,602,563 | 7/1986 | Soini | 101/186 |
| 5,158,018 | 10/1992 | Masaki et al. | 101/158 |
| 5,272,980 | 12/1992 | Takeuchi et al. | 101/DIG. 36 |

FOREIGN PATENT DOCUMENTS

| | | | |
|---|---|---|---|
| 0119091 | 5/1987 | Japan | 101/158 |
| 0138246 | 6/1987 | Japan | 101/158 |
| 376676 | 3/1989 | Japan . | |
| 0061539 | 3/1991 | Japan | 101/158 |
| 0071877 | 3/1991 | Japan | 101/158 |
| 0083683 | 4/1991 | Japan | 101/158 |

*Primary Examiner*—Ren Yan

*Attorney, Agent, or Firm*—Sughrue, Mion, Zinn, Macpeak & Seas

[57] ABSTRACT

Disclosed is a roller offset printing apparatus which comprises image sensors 14 and 15 disposed on a linear stage 4, and position correction motors 8 to 13 disposed in the respective peripheries of a master plate 6 and a work plate 7, wherein positions of the master plate 6 and the work plate 7 on the linear stage 4 are detected by the image sensors 14 and 15 so that the respective positions of the master plate 6 and the work plate 7 are corrected by the motors 8 to 13 in accordance with the quantities of displacement when there is any displacement between the detected positions and reference positions. After correction, the linear stage 4 and a roller transfer drum 1 are moved while being synchronized with each other to thereby perform transfer. As a result, accuracy in positioning of the master plate and the work plate on the linear stage is improved, so that good superposition printing is provided.

8 Claims, 13 Drawing Sheets

ROLLER OFFSET PRINTING APPARATUS

BACKGROUND OF THE INVENTION

The present invention relates to an apparatus for printing a color superposition image, and particularly relates to a roller offset printing apparatus adapted to production of patterns such as liquid crystal color filter patterns, exposure mask patterns, liquid crystal shadow mask patterns, etc.

Referring to FIGS. 6 and 7, there is shown a conventional roller offset printing apparatus which has a roller transfer drum 101 covered with a rubber sheet and adapted to be rotated by a rotation motor 102, a linear stage 103, pinions 101*a* and 101*b* provided at opposite ends of the roller transfer drum 101, racks 103*a* and 103*b* provided at opposite side edges of the linear stage 103 so as to be engaged with the pinions 101*a* and 101*b* respectively, a master plate 106 and a work plate 107 disposed at a predetermined interval on the linear stage 103, and ink pits 121 (the diagrams (b) and (c) of FIG. 7 for reserving ink in a surface of the master plate 106.

As shown in the diagram (a) of FIG. 7, the pinions 101*a* and 101*b* are engaged with the racks 103*a* and 103*b* respectively, so that the roller transfer drum 101 moves while rotating on the linear stage 103 when the rotation motor 102 is driven. When the roller transfer drum 101 rotates on the surface of the master plate 106, ink 120 in the ink pits 121 is transferred onto the outer circumferential surface of the roller transfer drum 101 (the diagram (b) of FIG. 7). When the roller transfer drum 101 further rotates on the surface of the work plate 107, the ink 120 is transferred from the outer circumferential surface of the roller transfer drum 101 onto the surface of the work plate 107 (the diagram (c) of FIG. 7).

Thus, the conventional apparatus uses such a driving system that the roller transfer drum 101 is rotated through the engagement between the pinions 101*a* and 101*b* and the racks 103*a* and 103*b* as described above. Accordingly, a displacement may be produced between an original image on the master plate 106 and a printed image on the work plate 107 because of backlash, abrasion, etc. This arouses a problem in superposition printing.

Further, in the conventional apparatus, slipping of the roller transfer drum 101 occurs on the surface of the master plate 16 or on the surface of the work plate 107 so that high accurate printing is prevented.

Further, referring to FIGS. 11 through 13, there is shown another conventional known roller offset printing apparatus which has a roller transfer drum 130 adapted to be rotated by a motor not shown, a stage 133 provided with a master plate 131 and a work plate 132 placed thereon, left and right bearings 134 for supporting opposite ends of the roller transfer drum 130, left and right bearing accommodation boxes 135 for storing the bearings 134 respectively, left and right stands 136 for supporting the respective boxes 135 so that the respective boxes 135 can move up and down, left and right cylinders 137 for moving up and down the respective boxes 135, a rubber sheet (blanket) 138 wound on the outer circumferential surface of an iron roller 130*a* of the roller transfer drum 130, left and right pinions 130*b* formed at the opposite sides of the roller transfer drum 130, left and right bearers 130*c* formed at the opposite side edges of the roller transfer drum 130, left and right racks 133*a* provided at opposite sides of the stage 133 so as to be engaged with the pinions 130*b* respectively, and rails 133*b* provided at the opposite side edges of the stage 133 and having upper surfaces equal in level to the surfaces of the master and work plates 131 and 132.

In the conventional apparatus, the external size of the rubber sheet 138 is set so as to be equal to the external size of the left and right bearers 130*c*. Accordingly, when the roller transfer drum 130 is moved by the left and right cylinders 137 down to a position where the left and right bearers 130c come into contact with upper surfaces of the left and right rails 133*b*, the outer circumferential surface of the rubber sheet 138 comes into contact with the surface of the master plate 131 or the surface of the work plate 132 as shown in the diagram (a) of FIG. 13 and at the same time the left and right pinions 130*b* are engaged with the left and right pinions 133*a* as shown in FIG. 11. Further, in the conventional apparatus, a printing pressure adjustment shim 139 is disposed between the iron roller 130*a* and the rubber sheet 138 as shown in FIG. 12 in order to generate a predetermined printing pressure. Accordingly, when the transfer drum 130 is moved down as described above, the rubber sheet 138 is elastically deformed by the thickness $\delta$ of the shim 139 as show in the diagram (b) of FIG. 13 so that a predetermined printing pressure is generated.

Accordingly, in the conventional apparatus, when the printing pressure is to be changed, there is required the printing pressure adjusting work of removing the rubber sheet 138, replacing the shim 139 to a new one having a thickness in accordance with the printing pressure and then winding the rubber sheet 138 on the outer circumference of the new shim again. There arises a problem in that a long time is required for the printing pressure adjusting work because the printing pressure adjusting work is troublesome. There arises another problem in that a desired printing pressure cannot be set with high accuracy because of the variation of tolerance in the shim 139 and the error in the mounting of the shim 139.

In addition, in the conventional roller offset printing apparatus shown in FIG. 11, the rubber sheet (blanket) 138, as an elastic member, is wound on the outer circumferential surface of the iron roller 130*a* of the roller transfer drum 130. In the conventional apparatus, the ink in the ink pits (patterned recesses) in the surface of the master plate 131 is transferred onto the outer circumferential surface of the rubber sheet 130*a* and further transferred onto the surface of the work plate 132 when the roller transfer drum 130 is moved while being rotated on the surface of the master plate 131 or the surface of the work plate 132 placed on the stage. Thus, patterns on the master plate are printed on the work plate.

The rubber sheet 138 however expands and sags gradually because of the printing pressure (printing pressure) and the chemical reaction of the ink. When such sagging occurs, patterns on the master plate cannot be reproduced on the work plate accurately. There arises a problem in that printing accuracy deteriorates.

Further, in the conventional roller offset printing apparatus as shown in FIG. 11, opposite ends of the roller transfer drum 130 are supported by the left and right bearings 134 respectively. The left and right bearing accommodation boxes 135 for storing the bearings 134 are supported by the left and right stands 136 respectively so as to be movable up and down. Projections 135*a* are formed at opposite ends of each of the bearing accommodation boxes 135. The projections 135*a*, opposite end portions of each of the stands 136 and push plates 139 fixed to each of the stands 136 make up a linear guide.

In the conventional apparatus, the boxes 135 are supported by the stands 136 respectively so as to be movable up and down through the slide engagement of the projections 135*a* of the left and right boxes 135 with grooves formed by the left and right stands 136 and the push plates 139. Further, the engagement portions are provided with considerable gaps so that the boxes 135 can be moved up and down in a low friction. Accordingly, when the roller transfer drum (blanket drum) 1 is moved while being rotated on the surface of the master plate 131 and the surface of the work plate 132, the transfer drum 1 becomes unstable in the directions of the axis and radius thereof in accordance with the gaps. As a result, patterns on the master plate 131 cannot be reproduced on the work plate 132 accurately. There arises a problem in that printing accuracy deteriorates.

SUMMARY OF THE INVENTION

The present invention is attained in such circumstances and an object thereof is to provide a roller offset printing apparatus adapted to superposition printing.

In addressing the foregoing object, according to an aspect of the present invention, the roller offset printing apparatus comprises:. a linear stage movable forwards and backwards; a stage driving means for driving the linear stage; a roller transfer drum for transferring a pattern image to be transferred while being rotated; a roller transfer drum supporting means for rotatably supporting said roller transfer drum; a master plate and a work plate disposed at a predetermined interval on the linear stage, the master plate having ink pits formed in a surface of the master plate for reserving ink; a roller transfer drum driving means for driving the roller transfer drum so that the roller transfer drum rotates on the surface of the master plate to transfer the ink in the ink pits of the master plate onto the outer circumferential surface of the roller transfer drum and the roller transfer drum further rotates on a surface of the work plate to thereby transfer the ink from the outer circumferential surface of the roller transfer drum onto the surface of the work plate; a synchronizing means for driving the stage driving means and the roller transfer drum driving means under synchronization therebetween; a position detection means for detecting positions of the master and work plates respectively; and a correction means for correcting the respective positions of the master and work plates in accordance with quantities of displacement of the master and work plates from reference positions respectively when the detected positions of the master and work plates displace from the reference positions respectively.

The respective positions of the master and work plates are detected before transferring so that when the detected positions of the master and work plates displace from the reference positions respectively the respective positions of the master and work plates are corrected in accordance with the quantities of the displacement of the master and work plates. After correction, the linear stage and the roller transfer drum are moved under synchronization therebetween to thereby perform transferring.

DESCRIPTION OF THE PREFERRED EMBODIMENTS

Embodiments of the present invention will be described below with reference to the drawings.

Figure 1:
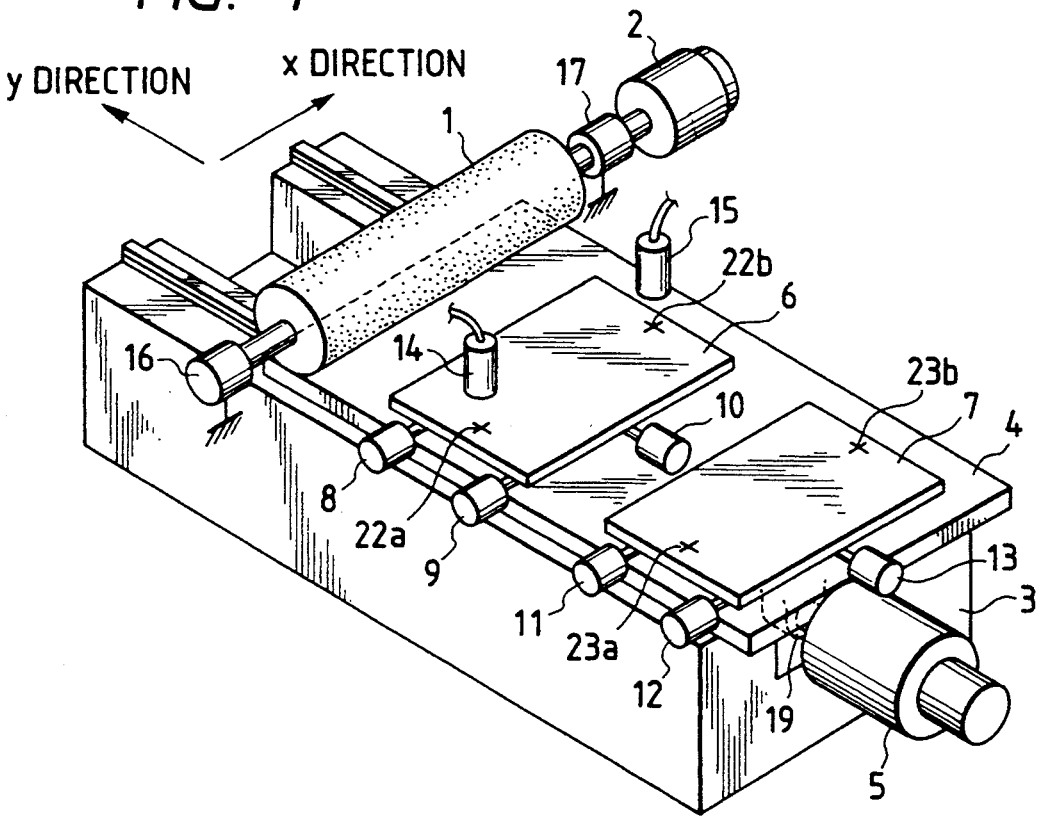
FIG. 1 is a perspective view showing a roller offset printing apparatus according to a first embodiment of the present invention.
Figure 6:
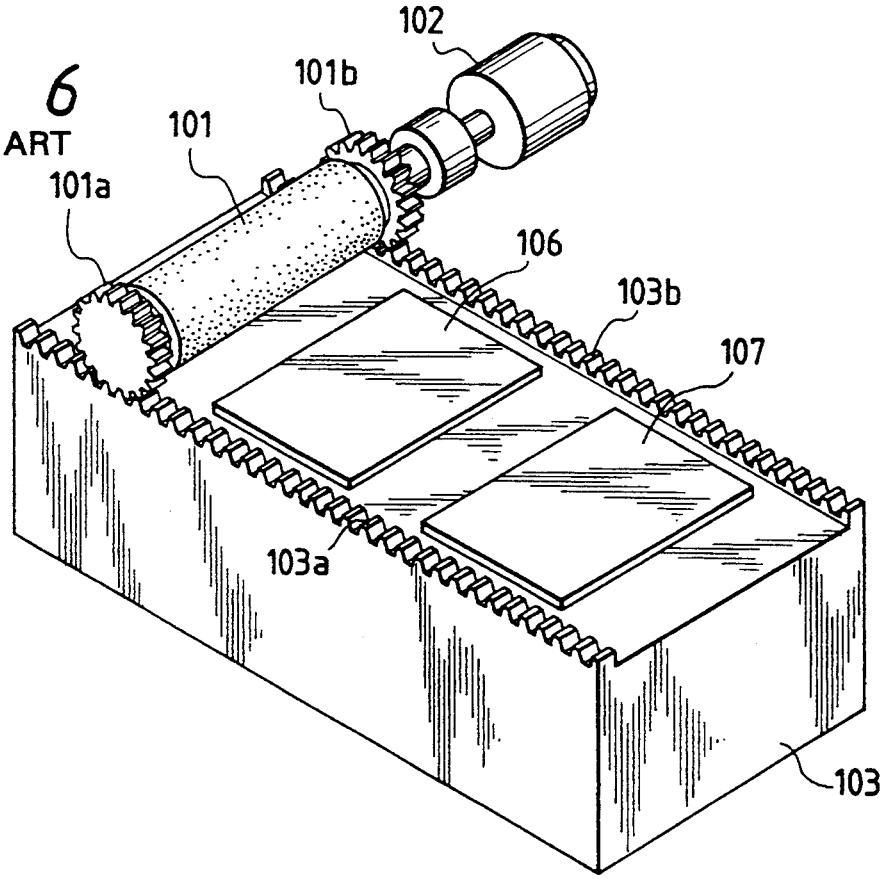
FIG. 6 PRIOR ART
FIG. 6 is a perspective view of a conventional roller offset printing apparatus.

Referring to FIGS. 1 through 8, a first embodiment of the present invention will be first described. FIG. 1 is a perspective view showing an embodiment of the roller offset printing apparatus according to the present invention. In the drawing, the reference numeral 1 designates a roller transfer drum; 2, a roller transfer drum motor; 3, a base; 4, a linear stage provided on the base 3; 5, a linear stage motor; 6, a master plate provided at a predetermined position on the linear stage 4; 7, a work plate provided at a predetermined position on the linear stage 4; 8 to 10, master plate side motors; 11 to 13, work plate side motors; and 14 and 15, image sensors.

The roller transfer drum 1 is covered with a rubber sheet and rotatably supported at its opposite ends by bearings 16 and 17. A rotary shaft of the roller transfer drum motor 2 as the roller transfer drum driving means is connected to one end of the roller transfer drum 1.

Figure 2A:
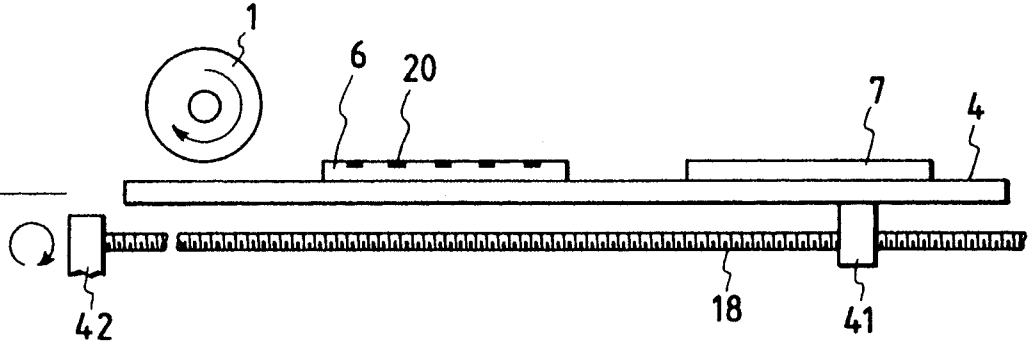
FIGS. 2(*a*)–2(*c*) are views for explaining the operation of the roller offset printing apparatus.
Figure 2B:
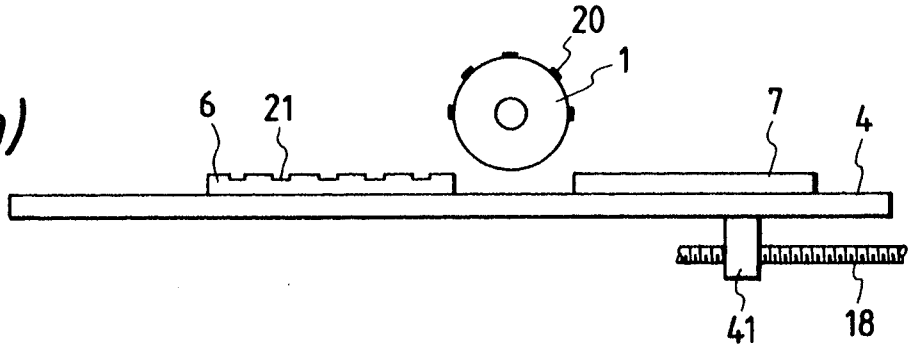
Figure 2C:
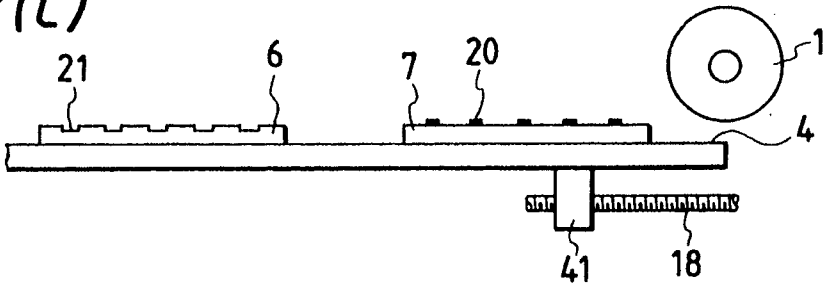

Between the linear stage 4 and the base 3, there is provided a stage driving means constituted by a driving screw 18 connected to the rotary shaft of the linear stage motor 5 mounted on the base 3, a nut 19 thread-engaged with the driving screw 18, a support member 41 attached to the linear stage 6 to support the nut 19, and another support member 42 attached to the base 3 to rotatably support the driving screw 18 (see FIG. 2).

The master plate 6 is made of glass and provided with ink pits 21 (the diagram (b) of FIG. 2) which are formed in a surface of the master plate 6 so as to reserve ink 20 therein. The ink 20 is injected into the ink pits 21 through an ink jet, a doctor brush, a wiper spattula or the like. Further, alignment marks 22*a* and 22*b* for correcting positional displacement are exhibited on the surface of the master plate 6. In the periphery of the master plate 6, not only the master plate side motors 8 and 9 are provided for moving the master plate 6 in an x-direction but a master plate side motor 10 is provided for moving the master plate 6 in a y-direction.

The work plate 7 is made of a material such as glass, aluminum, etc. Alignment marks 23*a* and 23*b* for correcting positional displacement are exhibited on the surface of the work plate 7. In the periphery of the work plate 7, not only work plate side motors 11 and 12 are provided for moving the work plate 7 in the x-direction but a work plate side motor 13 is provided for moving the work plate 7 in the y-direction.

Figure 3:
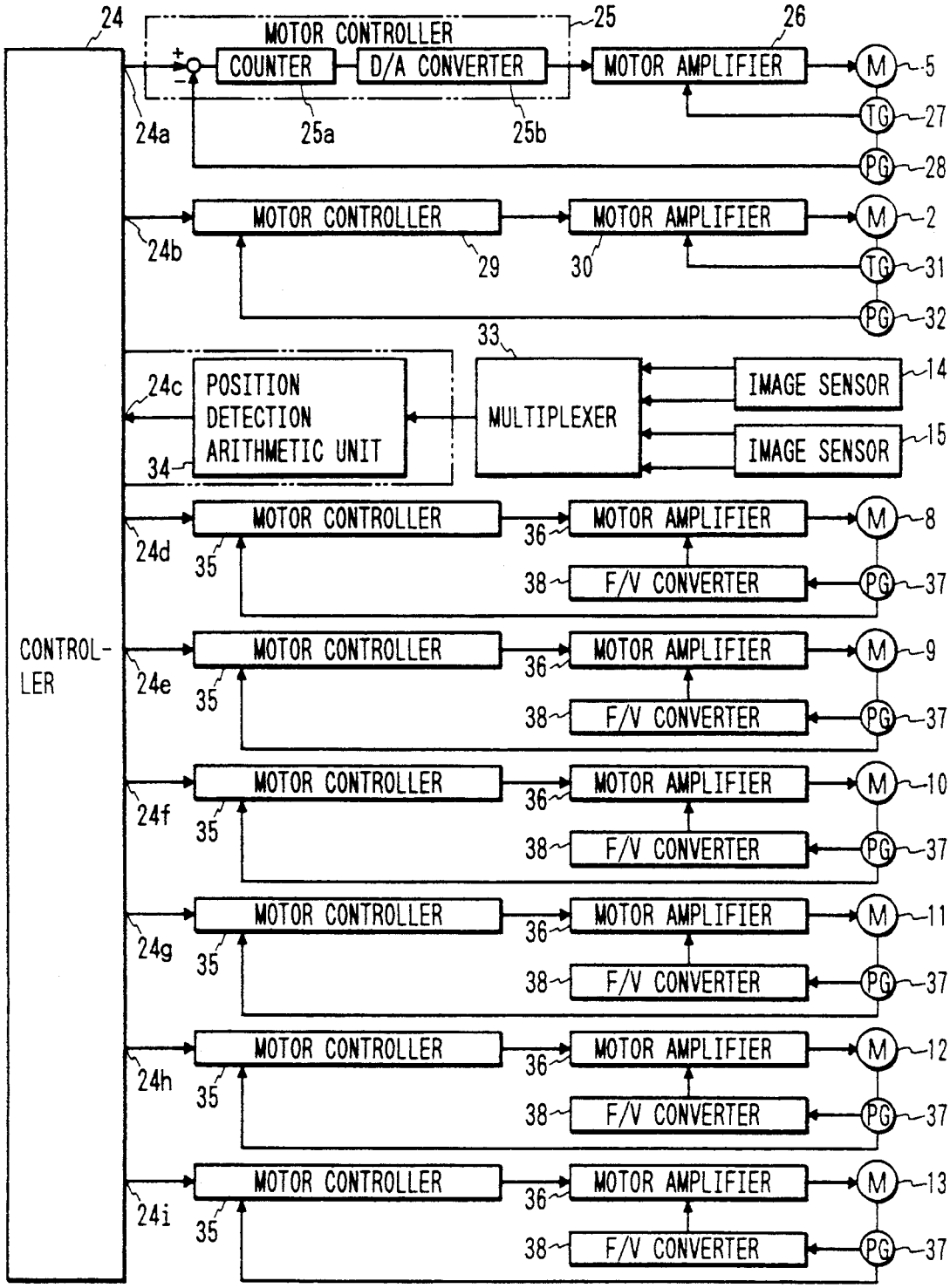
FIG. 3 is a block diagram of the roller offset printing apparatus.

FIG. 3 is a block diagram of the roller offset printing apparatus. In the drawing, the reference numeral 24 designates a controller. The linear stage motor 5 is connected to an output terminal 24*a* of the controller 24 through a motor controller 25 and a motor amplifier 26. The motor controller 25 has a counter 25*a* for comparing a moving instruction signal supplied from the controller 24 with a position signal supplied from an encoder (pulse generator) 28, and a D/A converter 25*b* for converting a deviation as a result of the comparison into an analog quantity. After D/A conversion, the moving instruction signal is amplified by the motor amplifier 26 so that the linear stage motor 5 is driven on the basis of the amplified signal. The encoder 28 is provided for moving the linear stage 4 to a predetermined position while checking the current position of the linear stage 4 on the basis of position information. A tachometer generator 27 applies a voltage change generated in accordance with the rotational speed of the linear stage motor 5 to the motor amplifier 26 to thereby control the voltage (speed) so as to be kept constant.

The roller transfer drum motor 2 is connected to another output terminal 24*b* of the controller 24 through a motor controller 29 and a motor amplifier 30. Similarly to the case of the linear stage motor 5, the motor controller 29 compares a moving instruction signal supplied from the controller 24 with a signal supplied from an encoder 32. The D/A converted moving instruction signal is amplified by the motor amplifier 30 so that the roller transfer drum motor 2 is driven on the basis of the amplified signal. The encoder 32 is provided for moving the roller transfer drum 1 by a predetermined angle while confirming the current angle on the basis of position information of the roller transfer drum 1. The tachometer generator 27 applies a voltage change generated in accordance with the rotational speed of the roller transfer drum motor 2 to the motor amplifier 30 to thereby control the voltage (speed) so as to be kept constant.

The image sensors 14 and 15 are connected to an input terminal 24*c* of the controller 24 through a multiplexer 33 and a position detection arithmetic unit 34. The quantities of displacement of the alignment marks 22*a*, 22*b*, 23*a* and 23*b* on the master plate 6 and the work plate 7 are read successively from position detection signals of the image sensors 14 and 15 by the position detection arithmetic unit 34 (while being switched by the multiplexer 33), and an output signal from the arithmetic unit 34 is supplied as an alignment signal to the controller 24.

The master plate side motor 8 is connected to a further output terminal 24*d* of the controller 24 through a motor controller 35 and a motor amplifier 36. The motor controller 35 compares the alignment signal supplied from the controller 24 with a signal supplied from an encoder 37 and converts a deviation between the signals into an analog quantity. After D/A conversion, the alignment signal is amplified by the motor amplifier 36 so that the master plate side motor 8 is driven on the basis of the amplified signal. An F/V converter 38 converts a signal frequency supplied from the encoder 37 into a voltage and gives the voltage as a feedback signal to the motor amplifier 36 to thereby control the voltage so as to be kept constant.

Circuits for driving the master plate side motors 9 and 10 can be formed in the same manner as in the aforementioned circuits, and the description thereof will be omitted. By the same reason, the description of circuits for driving the work plate side motors 11 to 13 will be omitted.

The operation of the roller offset printing apparatus in this embodiment will be described below.

When the linear stage motor 5 is driven, the driving screw 18 is rotated so that the linear stage 4 is guided by the driving screw 18 so as to move in the y-direction in FIG. 1. At the same time, the master plate 6 on the linear stage 4 is moved and once stopped at a position where the image sensors 14 and 15 and the alignment marks 22*a* and 22*b* are in opposition to each other respectively.

The quantities of displacement (x-direction displacement and y-direction displacement) of the alignment marks 22*a* and 22*b* on the master plate 6 from predetermined reference positions are detected on the basis of optical signals from the image sensors 14 and 15 and read by the position detection arithmetic unit 34, and an output signal of the arithmetic unit 34 is supplied as an alignment signal to the controller 24.

When the alignment signal is supplied from the controller 24 to the master plate side motors 8 to 10, the master plate side motor 8 to 10 are driven on the basis of the alignment signal. As a result, the quantities of displacement of the master plate 6 are corrected so that the master plate 6 can be placed in a correct position.

Thereafter, the linear stage 4 is moved by a predetermined reference quantity in the y-direction in FIG. 1 so that the work plate 7 is stopped at a position where the image sensors 14 and 15 and the alignment marks 23*a* and 23*b* are in opposition to each other respectively. Then, the quantities of displacement of the alignment marks 23*a* and 23*b* on the work plate 7 are detected and read by the position detection arithmetic unit 34 and an output signal of the arithmetic unit 34 is supplied as an alignment signal to the controller 24.

When the alignment signal is supplied from the controller 24 to the work plate side motors 11 to 13, the work plate side motor 11 to 13 are driven on the basis of the alignment signal. As a result, the quantities of displacement of the work plate 7 are corrected so that the work plate 7 can be placed in a correct position.

On the basis of the moving instruction signal supplied from the controller 24, not only the roller transfer drum motor 2 is driven to rotate the roller transfer drum 1 but the linear stage motor 5 is driven to move the linear stage 4 (the diagram (a) of FIG. 2). When the roller transfer drum 1 rotates while being in contact with the surface of the master plate 6, the ink 20 in the ink pits 21 is transferred onto the outer circumferential surface of the roller transfer drum 1 (the diagram (b) of FIG. 2). When the roller transfer drum 1 then rotates while being in contact with the surface of the work plate 7, the ink 20 is transferred from the outer circumferential surface of the roller transfer drum 1 onto the surface of the work plate 7 (the diagram (c) of FIG. 2).

In the case of this embodiment, the roller transfer drum motor 2 and the linear stage motor 5 are rotated while being differentially synchronized with each other. That is, the motor controllers 25 and 29 compare the moving instruction signal supplied from the controller 24 with signals supplied from encoders 28 and 32, convert deviations between the signals into analog quantities and amplify the analog signals through motor amplifiers 26 and 30 to thereby drive the linear stage motor 5 and the roller transfer drum motor 2 respectively.

Figure 4:
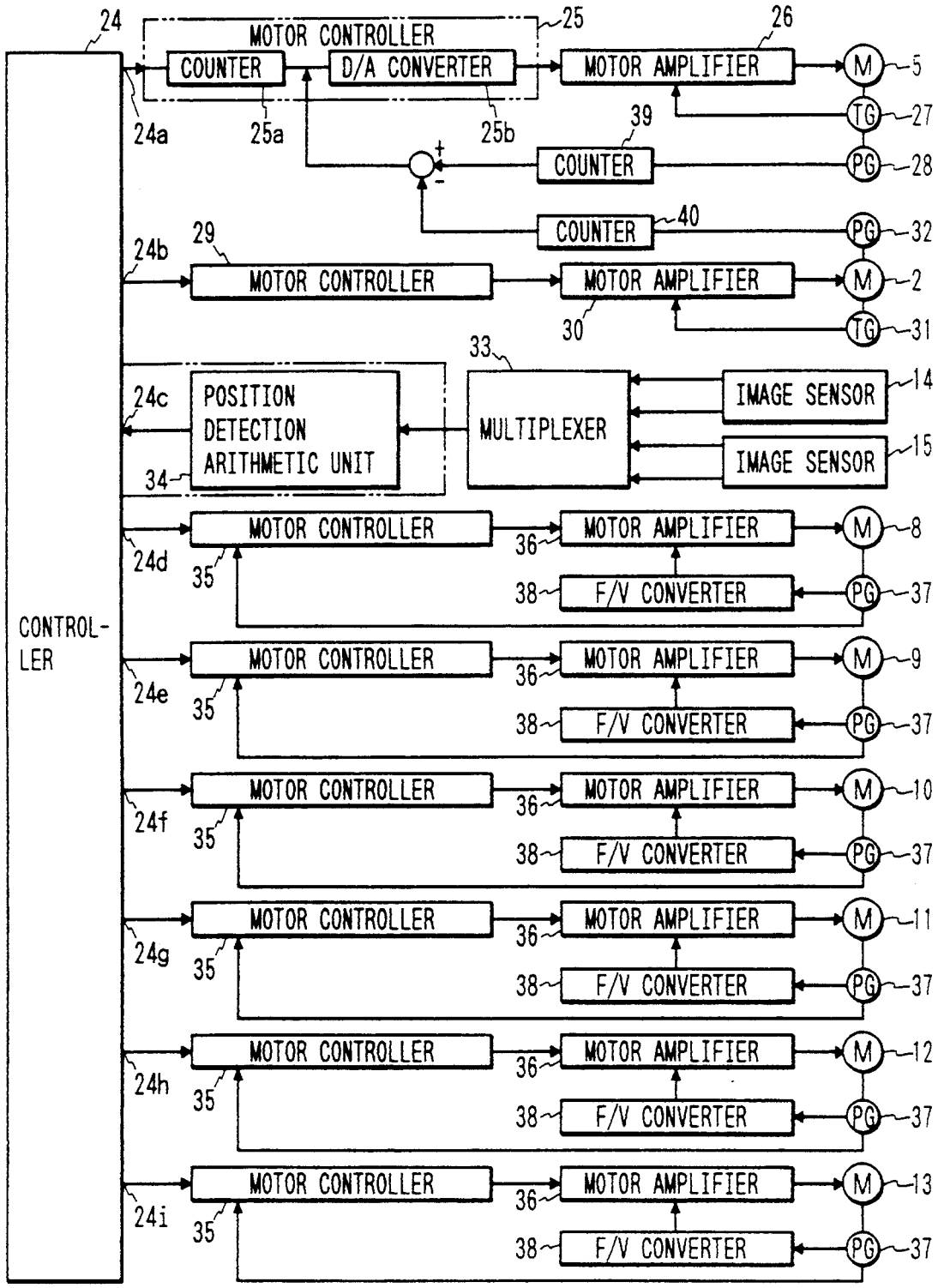
FIG. 4 is a block diagram of a roller offset printing apparatus according to a second embodiment of the present invention.

FIG. 4 is a block diagram of a second embodiment. In the description of this embodiment, the parts the same as those in the first embodiment are referenced correspondingly. The description of the parts will be omitted except the description of parts different from those in the first embodiment.

In the case of this embodiment, the roller transfer drum motor 2 and the linear stage motor 5 are rotated while being feed-synchronized with each other. That is, a position signal is supplied from the stage motor 5 side encoder 28 to a counter 39 while a signal is supplied from the roller transfer drum motor 2 side encoder 32 to a counter 40. A signal outputted from the counter 39 is compared with a signal outputted from the counter 40 so that a deviation between the signals is fed as a differential signal back to the linear stage motor 5 side motor controller 25 and amplified by the motor amplifier 26 to thereby drive the linear stage motor 5. The motor used in this case is preferably constituted by a stepping motor.

Figure 5:
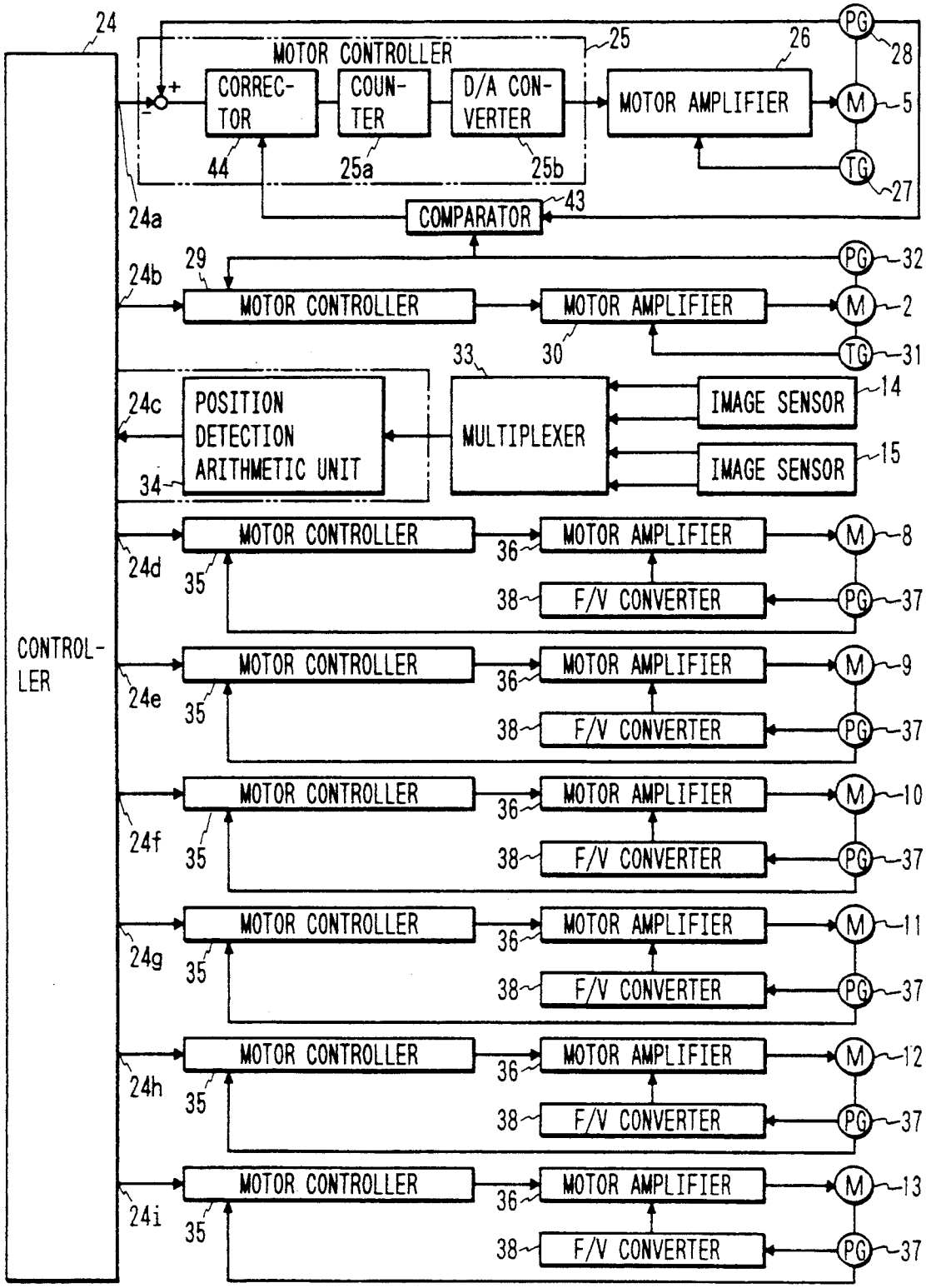
FIG. 5 is a block diagram of a third embodiment related to feed-synchronizing control of the stage motor and the roller transfer drum motor.
Figure 7A:
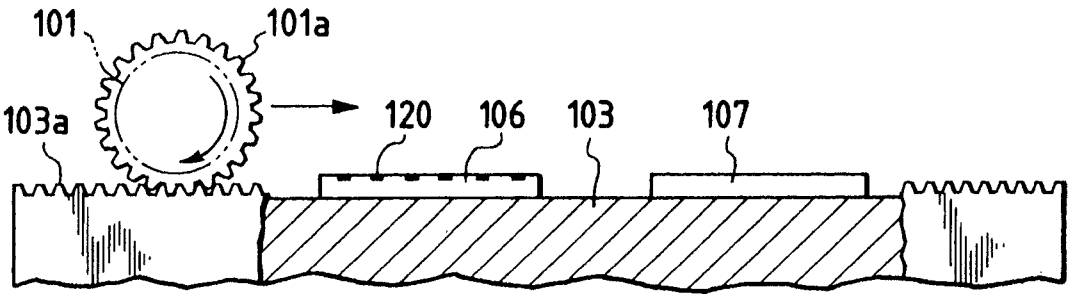
FIG. 7(a) PRIOR ART
FIGS. 7(*a*)–7(*c*) are views for explaining the operation of the conventional roller offset printing apparatus.
Figure 7B:
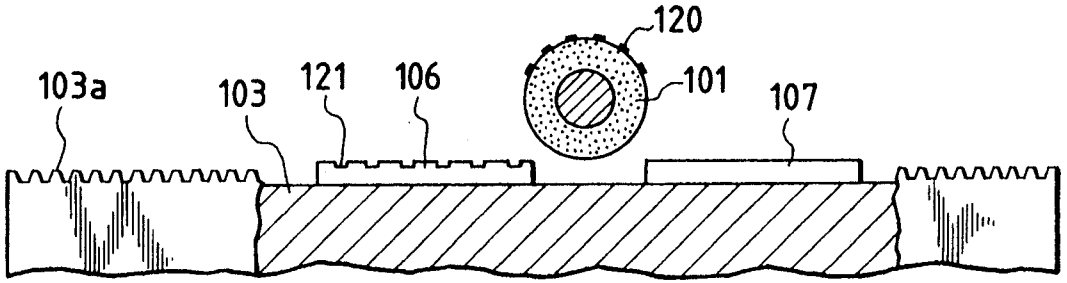
FIG. 7(b) PRIOR ART
Figure 7C:
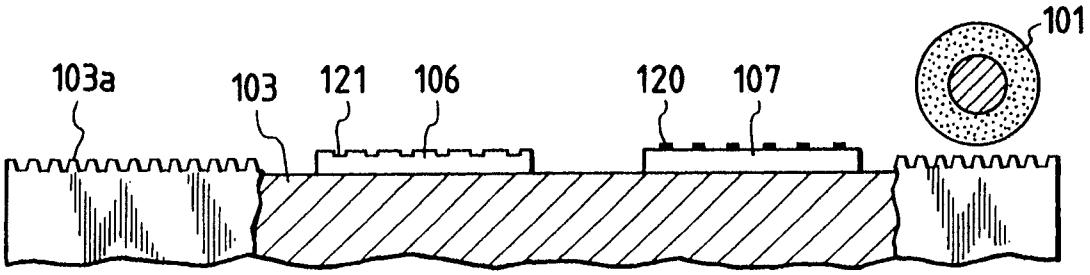
FIG. 7(c) PRIOR ART

FIG. 5 shows a third embodiment related to feed synchronizing control of the stage motor 5 and the roller transfer drum motor 2.

In this embodiment, the parts the same as those in the previous embodiment are referenced correspondingly and the description thereof is therefore omitted. That is, only the parts different from those in the previous embodiment will be described.

In this embodiment, the roller transfer drum motor 2 and the linear stage motor 5 are rotated while being feed-synchronized with each other. That is, the position signal supplied from the stage motor 5 side encoder 28 and the position signal supplied from the roller transfer drum 2 side encoder 32 are inputted to a comparator 43 so as to be compared with each other, so that a deviation between the signals is fed back to a compensator 44 of the linear stage motor 5 side motor controller and amplified by the motor amplifier 26 to thereby drive the linear stage motor 5.

Because inputs of the stage motor 5 side encoder 28 and the roller transfer drum motor 2 side encoder 32 are supplied to the motor controllers 25 and 29 respectively, the position of the linear stage and the rotational position of the roller transfer drum can be differentially corrected in accordance with the instruction supplied from the controller 24, that is, they can be subjected to feedback control.

Figure 8:
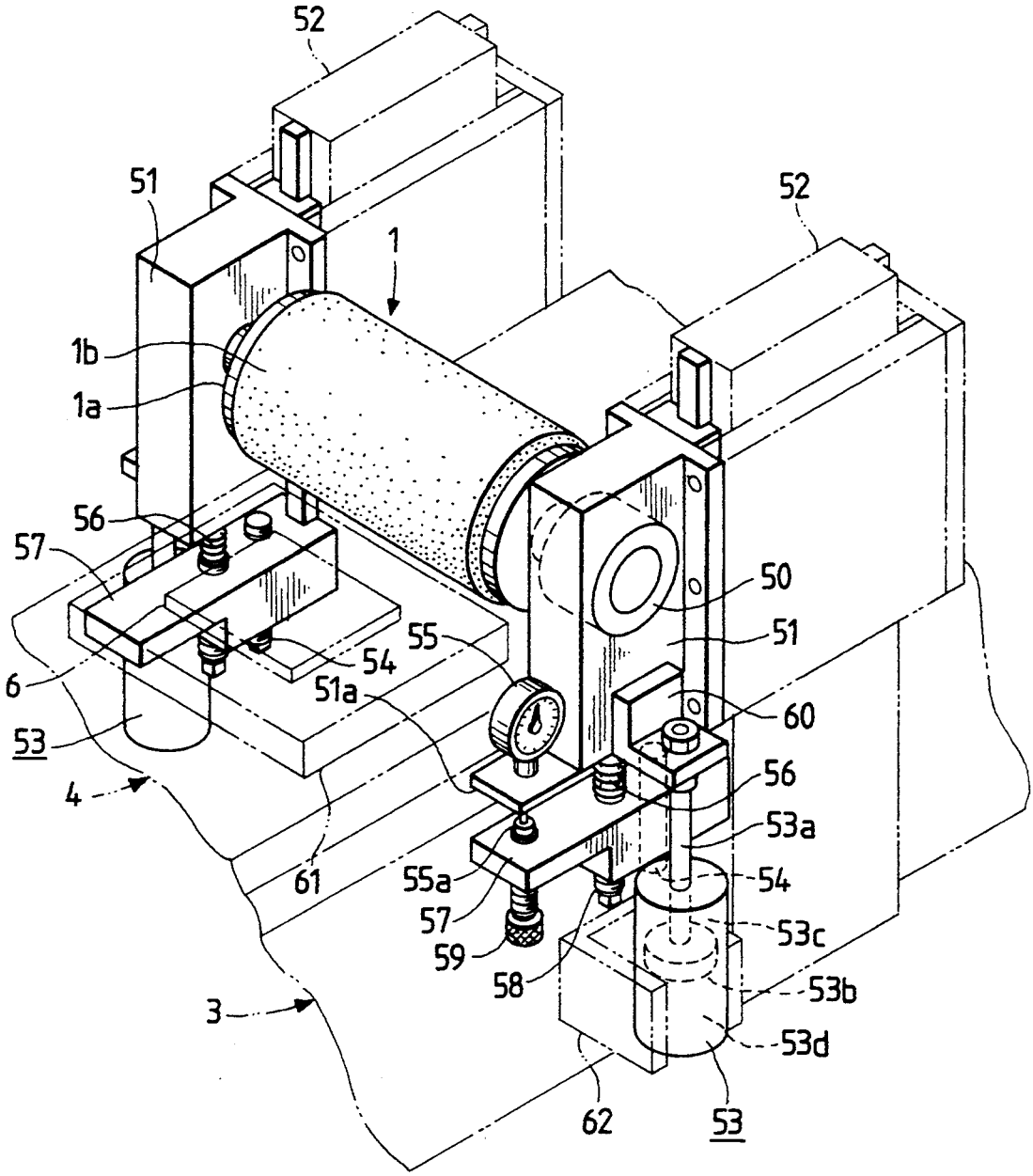
FIG. 8 is a perspective view showing a printing pressure adjuster adapted to the roller offset printing apparatus according to a fourth embodiment of the present invention.
Figure 9:
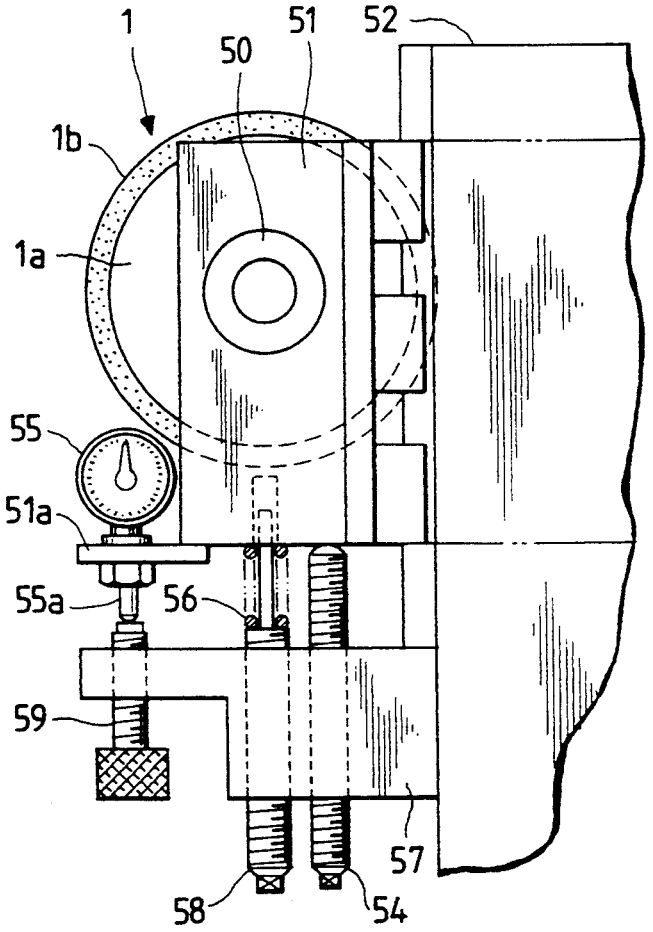
FIG. 9 is a side view showing important part of the printing pressure adjuster shown in FIG. 8.
Figure 10A:
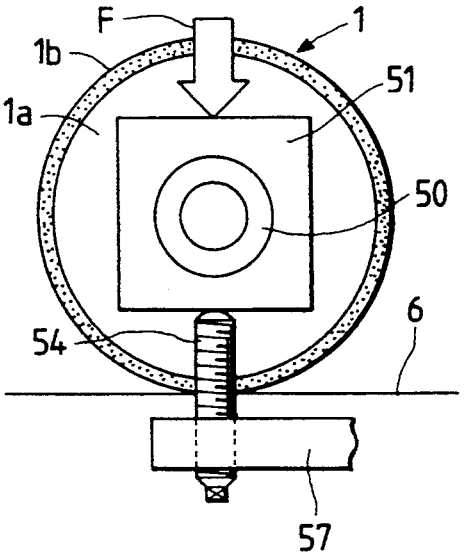
FIGS. 10(*a*)–10(*b*) are explanatory views in which the diagram 10(*a*) shows the condition in which the printing pressure of the roller transfer drum is 0, and the diagram 10(*b*) shows the condition in which a predetermined printing pressure is given to the roller transfer drum.
Figure 10B:
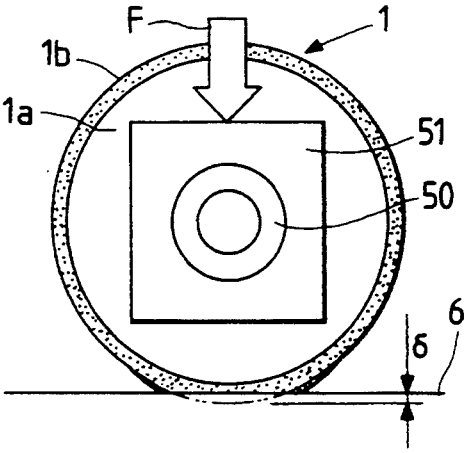

Referring to FIGS. 8 through 10, a fourth embodiment of the present invention will be described below.

The fourth embodiment relates to a printing pressure adjuster in the roller offset printing apparatus described above in the first embodiment with reference to FIG. 1.

Figure 11:
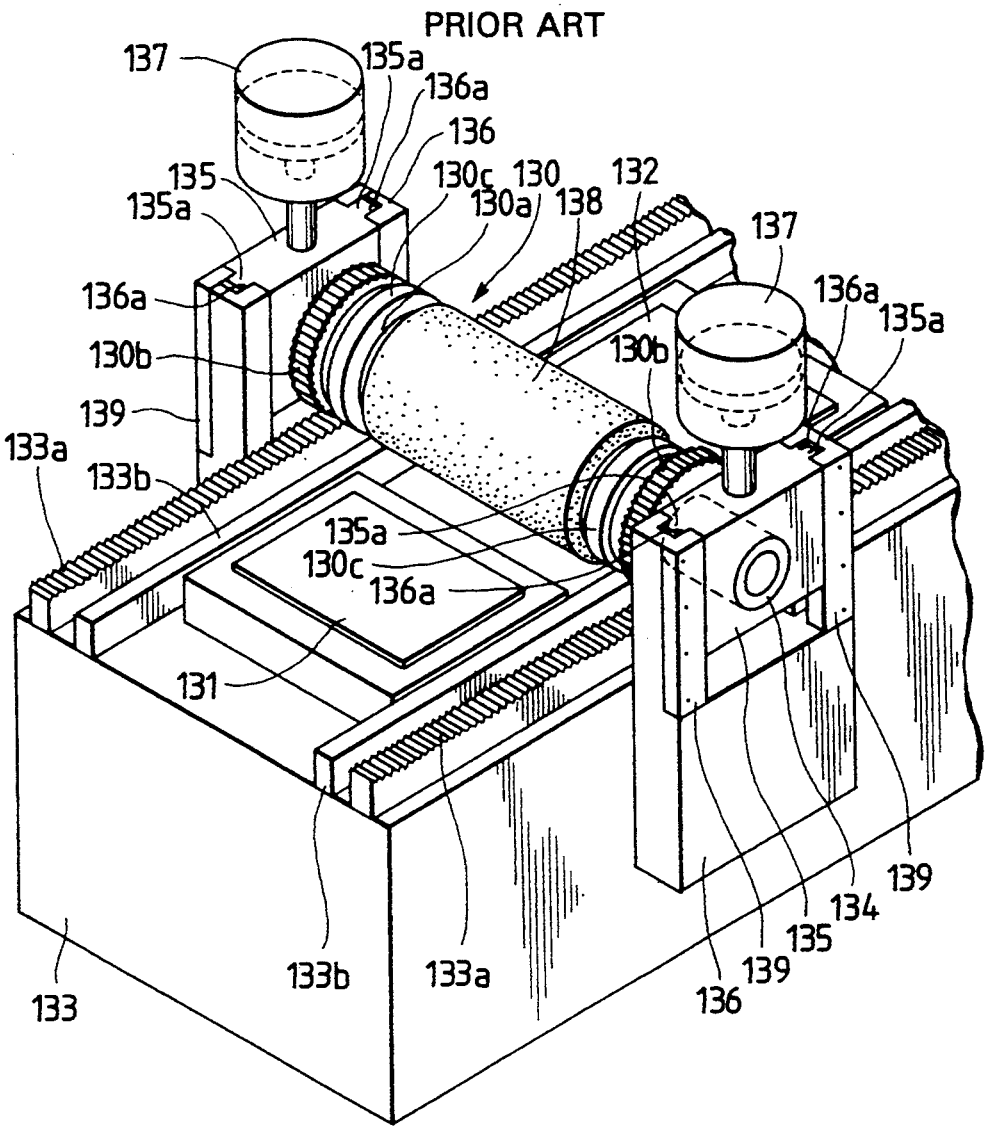
FIG. 11 PRIOR ART
FIG. 11 is a perspective view showing a conventional roller offset printing apparatus used for the description of the fourth embodiment shown in FIG. 8.
Figure 12:
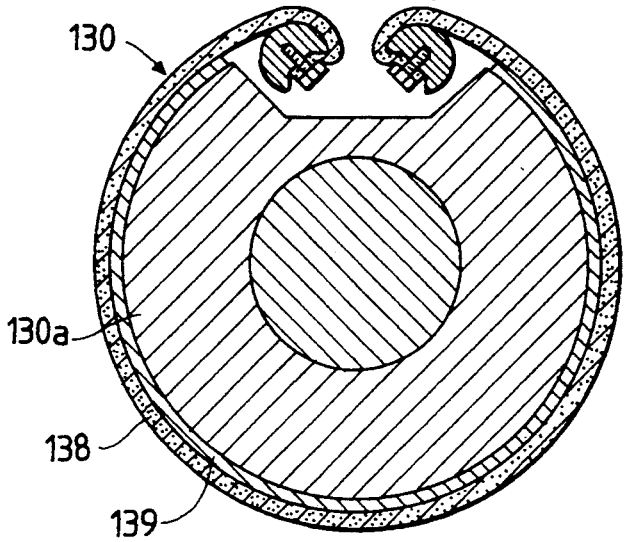
FIG. 12 PRIOR ART
FIG. 12 is a sectional view of the roller transfer drum shown in FIG. 11.
Figure 13A:
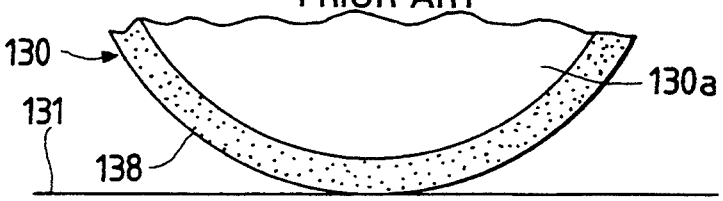
FIG. 13(a) PRIOR ART
FIGS. 13(*a*)–13(*b*) are explanatory views of the conventional apparatus shown in FIG. 11, in which the diagram 13(*a*) shows the condition in which the printing pressure of the roller transfer drum is 0, and the diagram 13(*b*) shows the condition in which a predetermined printing pressure is given to the roller transfer drum.
Figure 13B:
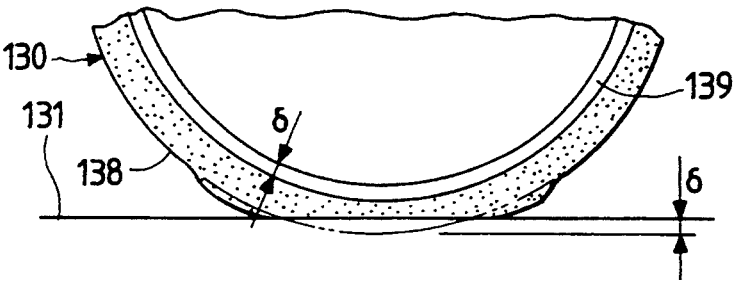
FIG. 13(b) PRIOR ART

The fourth embodiment provides a printing pressure adjuster adapted to the roller offset printing apparatus thus to solve the problems in the conventional apparatus described above with respect to FIGS. 11 and 12.

FIG. 8 shows the printing pressure adjuster adapted to the roller offset printing apparatus according to the fourth embodiment. For example, the printing pressure adjuster can be used as a part of the roller transfer drum supporting mechanism in the roller offset printing apparatus of the first embodiment shown in FIG. 1.

However, there are two types of the printing pressure adjuster according to the present invention, one is a constant position pressurization type and the other is a constant pressure pressurization type.

As shown in FIGS. 8 and 9, the printing pressure adjuster of the constant pressure type has left and right bearings 50 for supporting opposite ends of the roller transfer drum (blanket drum) 1, left and right bearing accommodation boxes 51 for storing the respective bearings 50, left and right stands 52 for supporting the respective boxes 51 so that the respective boxes can move up and doing, left and right cylinders 53 serving as actuators for moving up and down the respective boxes 51, stopper bolts 54 for limiting the descending positions of the respective boxes 51, a dial gauge 55 as a boxes position detecting means for detecting a position of the boxes, and taring coiled springs 56 for taking away the sum (for example, hundreds of kilograms) of the tare weights of the roller transfer drum 1 and the left and right boxes 51. Only the rubber sheet (blanket) 1*b* is wound on the outer circumference of the iron roller la of the roller transfer drum 1. That is, the printing pressure adjustment shim as provided in the conventional apparatus is not disposed between the iron roller 1*a* and the rubber sheet 1*b*.

Support members 57 are integratedly provided near lower ends of the left and right stands 52 respectively. The stopper bolts 54, adjustment screws 58 for adjusting the urging forces of the coiled springs 56, and a transfer drum position transmission member 59 having its upper end surface brought into contact with a forward end portion of a spindle 55*a* of the dial gauge 55 to thereby transmit the up and down movement of the roller transfer drum 1 to the spindle 55*a*, are attached to the respective support members 57. The dial gauge 55 is supported by a support plate 51*a* fixed to one of the left and right boxes 51.

Forward end portions of piston rods 53*a* of the cylinders 53 are fastened to brackets 60 fixed to lower end portions of the boxes 51 respectively. Each of the cylinders 53 is formed so that the piston 53*b* and the rod 53*a* are moved down to thereby move down the box 51 when operation pressure is supplied to an upper pressure chamber 53*c* formed at an upper portion of the piston 53*b*, and the piston 53*b* and the rod 53*a* are moved up to thereby move up the box 51 when operation pressure is supplied to a lower pressure chamber 53*d* formed at a lower portion of the piston 53*b*. The cylinders 53 are fixed to opposite side surfaces of the base 3 through brackets 62 respectively.

The procedure of setting the printing pressure by using the printing pressure adjuster according to the fourth embodiment having the aforementioned configuration will be described below.

First, the roller transfer drum 1 is moved up by the left and right cylinders 53 so that the outer circumferential surface of the roller transfer drum 1 is moved up away from the surface of the master plate 6.

Then, the roller transfer drum 1 is moved down gradually by driving down the left and right stopper bolts 54 while supplying descending force F from the respective cylinders 53 to the roller transfer drum 1.

When the roller transfer drum 1 is moved down to a position where the outer circumferential surface of the rubber sheet 1*b* comes into contact with the surface of the master plate 6 as shown in the diagram (a) of FIG. 10, the driving of the respective stopper bolts 54 is stopped to thereby stop the down movement of the roller transfer drum 1 and at the same time the dial gauge 55 is set at 0.

Then, the roller transfer drum 1 is further moved down gradually from the position shown in the diagram (a) of FIG. 10 by driving down the respective stopper bolts 54 while supplying descending force F from the respective cylinders 53 to the roller transfer drum 1. When the dial gauge 55 exhibits a numerical value corresponding to printing pressure to be set, the driving of the respective stopper bolts 54 is stopped to thereby stop the down movement of the roller transfer drum 1. If the relation between the quantity $\delta$ of deflection of the rubber sheet 1*b* (see the diagram (b) of FIG. 10) and the bearing pressure thereof is measured preliminarily, the quantity $\delta$ of deflection of the rubber sheet 1*b* corresponding to the printing pressure to be set can be read accurately from the numerical value of the dial gauge 55 so that the printing pressure can be set accurately to a desired value to be set.

As described above, in the fourth embodiment, not only the printing pressure can be set accurately to a desired value but the setting can be performed simply and in a short time.

Further, in the fourth embodiment, because the tare weights of the roller transfer drum 1 and the left and right boxes 51 are taken away by the rating coiled springs 56, the descending force F supplied from the left and right cylinders 53 to the boxes 51 at the time of setting of the printing pressure can be reduced. As a result, the force for driving the respective stopper bolts 54 can be reduced, so that the printing pressure can be set smoothly and accurately.

The fourth embodiment uses the printing pressure setting method (called "constant position pressurization method" in this specification) in which the lower limit position of the roller transfer drum 1 is determined by driving down the respective stopper bolts 54 while supplying moving-down force from the respective cylinders 53 to the roller transfer drum 1.

On the contrary to the above-mentioned constant position type, a printing pressure adjuster of the constant pressure type may be used, in which a constant pressure is supplied from the left and right cylinders 53 to the left and right boxes 51 so as to provide the quantity $\delta$ of deflection of the rubber sheet 1*b* corresponding to the printing pressure to be set when the roller transfer drum 1 is moved down to a position (position shown in the diagram (a) of FIG. 10) where the outer circumferential surface of the rubber sheet 1*b* comes into contact with the surface of the master plate 6 as described above without use of the left and right stopper bolts 54 for the lower limit position adjustment (deforming the rubber sheet 1*b* by $\delta$) of the roller transfer drum 1. At this time, a magnitude of the constant pressure is determined by utilizing a contact pressure gage or the like for detecting a contact pressure. The latter method is called "constant pressure pressurization method" in this specification.

However, the type of the printing pressure adjuster, the constant position pressurization type or the constant pressure pressurization type, can be selected properly. In addition, both types of the printing pressure adjusters can be provided in an apparatus in such a manner that one of them is selected properly.

Figure 14:
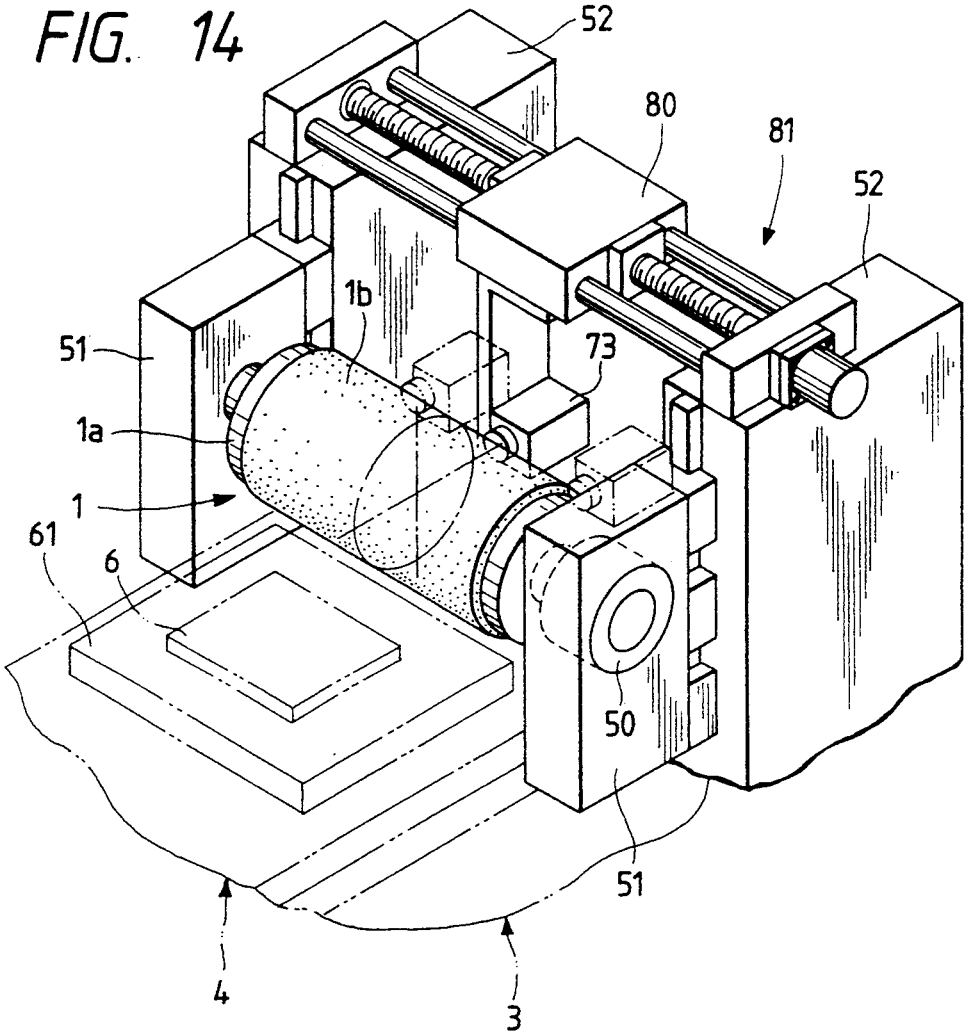
FIG. 14 is a perspective view showing a blanket automatic corrector adapted to the roller offset printing apparatus according to a fifth embodiment of the present invention.
Figure 15:
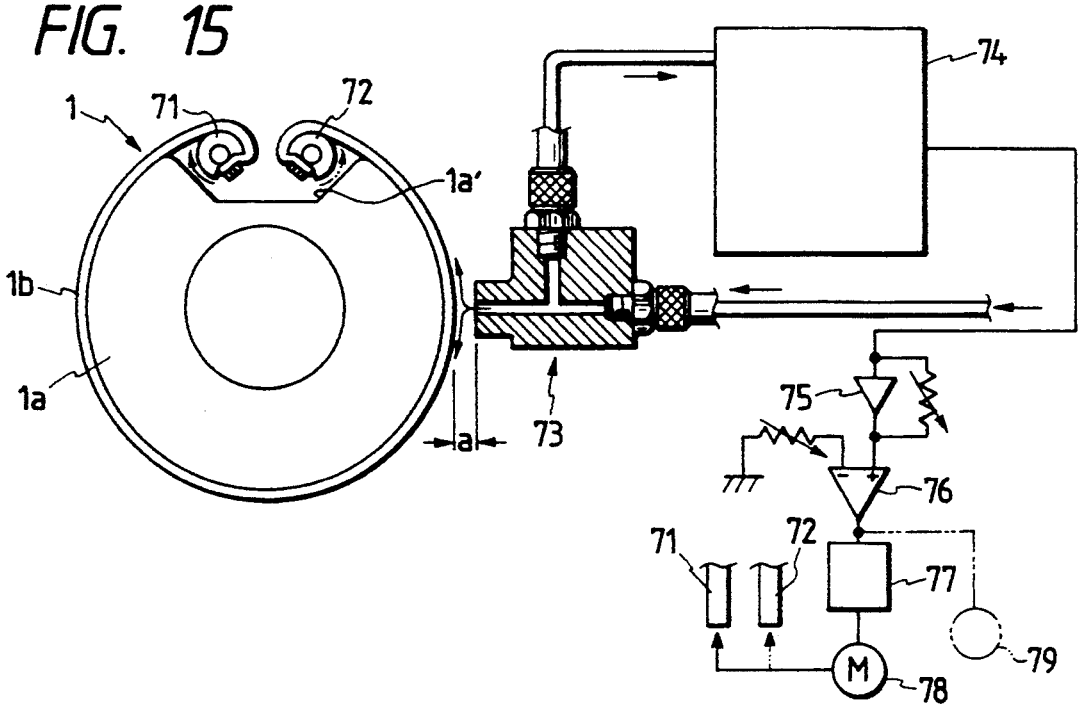
FIG. 15 is a schematic structural view of the blanket automatic corrector shown in FIG. 14.

Referring to FIGS. 14 and 15, a fifth embodiment of the present invention will be described below.

The fifth embodiment relates to a blanket automatic corrector, as a part of the roller transfer drum supporting means, for example, adapted to the roller offset printing apparatus described above in the fourth embodiment as shown in FIG. 8, for automatically correcting the sagging (or the like) of the rubber sheet (blanket) 1*b* wound on the roller transfer drum 1.

The fifth embodiment provides a blanket automatic corrector adapted to the roller offset printing apparatus in order to solve the problem in the conventional apparatus. In the description of the fifth embodiment, the parts the same as those in the fourth embodiment are referenced correspondingly to omit the overlapping description.

As shown in FIGS. 14 and 15, in the blanket automatic corrector of the roller offset printing apparatus according to the fifth embodiment, the rubber sheet (blanket) 1*b*, which acts as an elastic member, is wound on the iron roller 1*a* of the roller transfer drum 1. One end of the rubber sheet 1*b* and the other end thereof are wound on the outer circumferential surface of a takeup shaft 71 and the outer circumferential surface of a takeup shaft 72 respectively so as to be fixed thereto. The two takeup shafts 71 and 72 are rotatably supported within a cavity 1*a*' of the iron roller 1*a* so as to extend substantially in parallel to each other with separation of a predetermined distance. Although the outer circumference of the rubber sheet 1*b* is partly broken in accordance with the predetermined distance between the two takeup shafts 71 and 72, there is no special problem if the broken portion is set so as to be out of range used for printing.

As shown in FIG. 15, the blanket automatic corrector of the roller offset printing apparatus according to the fifth embodiment has an air micrometer 73 for jetting air of a predetermined pressure supplied from an air pressure supply portion not shown toward the outer circumferential surface of the rubber sheet 1*b* and for detecting the pressure of air reflected from the outer circumferential surface thereof, an air-voltage converter 74 for converting the air pressure detected by the air micrometer 73 into a voltage, an amplifier 75 for amplifying the output of the converter 74, a comparator 76 for comparing the value of the voltage amplified by the amplifier 75 with a reference voltage value and for outputting a signal in accordance with the difference between the voltage values, and a motor driver 77 for supplying a motor drive signal to a motor 78 in accordance with the output of the comparator 76. The motor 78 is connected to the takeup shaft 71 to rotate the takeup shaft 71 only in the direction of the arrow of FIG. 15 on the basis of the motor drive signal to thereby give tension to the rubber sheet 1*b*.

The reference voltage value given to the comparator 75 is set so that the value corresponds to a voltage value outputted from the air-voltage converter 74 when the distance a between the forward end of a nozzle portion of the air micrometer 73 and the outer circumferential surface of the rubber sheet 1*b* subjected to air jetted from the nozzle portion reaches a set value. Accordingly, when the outer circumferential surface of the rubber sheet 1*b* is loosened so that the distance a is in a value not larger than the set value, the value of the voltage supplied from the amplifier 75 to the comparator 76 becomes larger than the reference voltage value. As a result, a signal in accordance with the difference between the voltage values is supplied from the comparator 76 to the motor driver 77, so that the motor 78 rotates the takeup shaft 71 in the direction of the arrow of FIG. 15 on the basis of a motor drive signal outputted from the motor driver 77.

As shown in FIG. 14, the air micrometer 73 is supported by a slider 80. The slider 80 is supported by a slide mechanism 81 disposed at an upper end portion of the left and right stands 52 so that the slider 80 can move along the axial direction of the roller transfer drum 1. Accordingly, not only the air micrometer 73 can be moved along the outer circumferential surface of the rubber sheet 1*b* over the whole area in the axial direction thereof, but the sagging of the rubber sheet 1*b* can be detected by one air micrometer 73 over the whole area in the axial direction thereof.

In the fifth embodiment having the aforementioned configuration, air is jetted from the nozzle portion toward the outer circumferential surface of the rubber sheet 1*b* while the air micrometer 73 is reciprocated by the slide mechanism 81, for example, at intervals of a predetermined time.

When the outer circumferential surface of the rubber sheet 1*b* is partly loosened so that the distance a is in a value not larger than the set value, the value of the voltage (input voltage value) supplied from the amplifier 75 to the comparator 76 becomes larger than the reference voltage value. As a result, a signal in accordance with the difference between the voltage values is supplied from the comparator 76 to the motor driver 77, so that the motor 78 rotates the takeup shaft 71 in the direction of the arrow of FIG. 15 on the basis of a motor drive signal supplied from the motor driver 77. Accordingly, one end of the rubber sheet 1*b* is taken up by the takeup shaft 71, so that tension is given to the rubber sheet 1*b*.

When tension is given to the rubber sheet 1*b* so that the distance reaches the set value, that is, when the input voltage value becomes not larger than the reference value, the motor 78 is stopped.

As described above, in the fifth embodiment, because the sagging of the rubber sheet 1*b* is detected automatically so that the rubber sheet 1*b* is taken up by the takeup shaft 71 in accordance with the sagging to thereby give a suitable tension to the rubber sheet 1*b* when the sagging is detected, the sagging of the rubber sheet 1*b* can be corrected automatically. Accordingly, patterns on the master plate can be reproduced on the work plate accurately, so that printing accuracy can be improved. In the fifth embodiment, the takeup shafts 71 and 72 may be connected to the motor 78 as shown in FIG. 15 so that the takeup shafts 71 and 72 can be rotated in the respective directions of the arrows of FIG. 15 by the motor 78.

In the fifth embodiment, an alarming means 79 such as a lamp, a buzzer or the like may be connected to the comparator 76 as shown in FIG. 15 so that the alarming means 79 can be operated on the basis of the output signal of the comparator 76 when the rubber sheet 1*b* partly sags to thereby inform an operator that the rubber sheet 1*b* partly sags.

In the fifth embodiment, the air micrometer 73 which is movable may be replaced by a plurality of air micrometers which are fixed.

In the fifth embodiment, the parallelism of the takeup shafts 71 and 72 may be changed by the driving force of the motor 78 to thereby strengthen the tension of the rubber sheet 1*b* in order to set the sagging or vibration in a value not larger than a predetermined value over the whole area.

Figure 16:
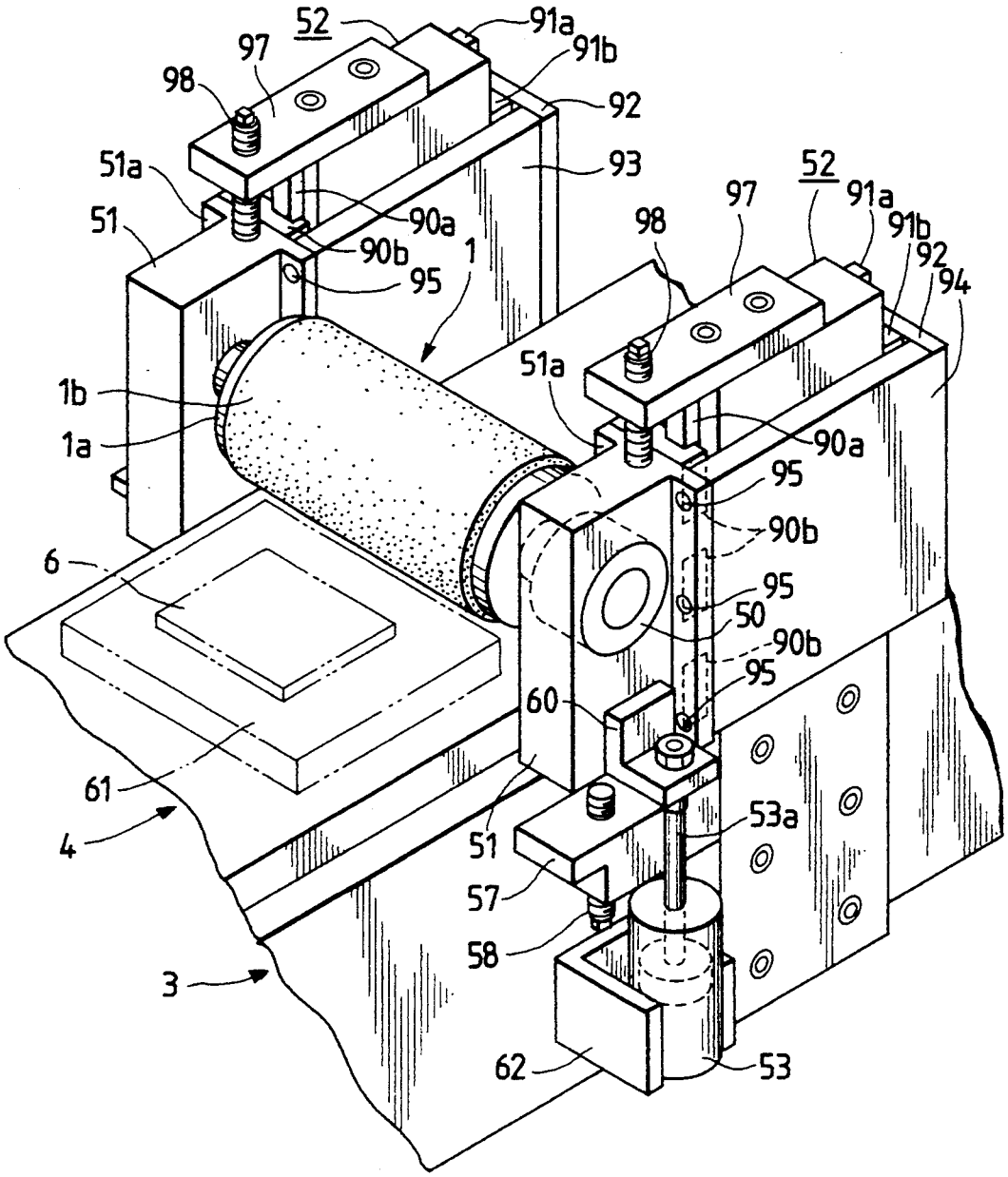
FIG. 16 is a perspective view showing a blanket supporter adapted to the roller offset printing apparatus according to a sixth embodiment of the present invention.
Figure 17:
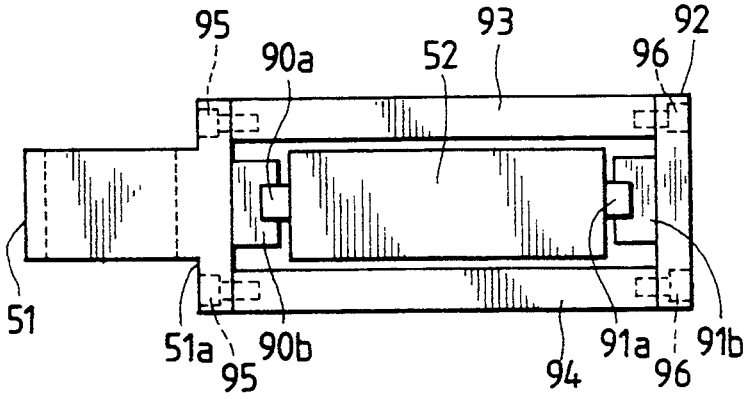
FIG. 17 is a plan view showing important part of the blanket supporter shown in FIG. 16.
Figure 18:
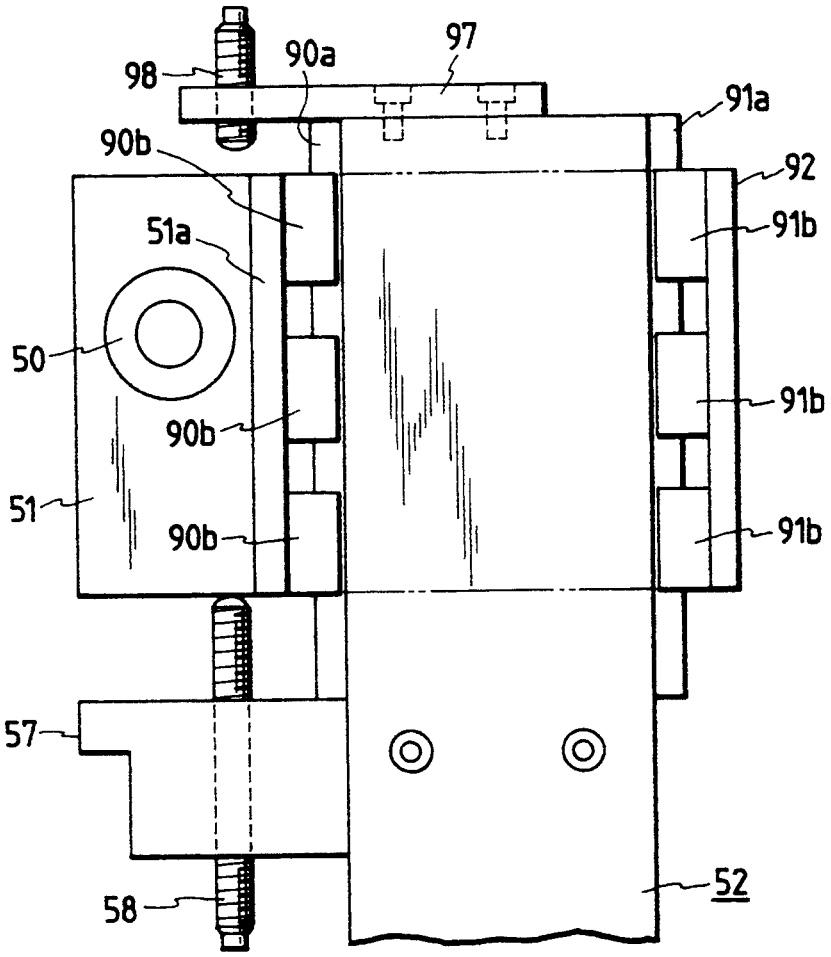
FIG. 18 is a side view showing important part of the blanket supporter shown in FIG. 16.

Referring to FIGS. 16 through 18, a sixth embodiment of the present invention will be described below.

The sixth embodiment relates to a blanket drum supporter, as a support guiding member for guiding the up-down movement of the bearing accommodation box for constructing a part of the roller transfer drum supporting means, for example, adapted to the roller offset printing apparatus described above in the first embodiment shown in FIG. 1.

The sixth embodiment provides the blanket drum supporter adapted to the roller offset printing apparatus in order to solve the problem in the conventional apparatus. In the description of the sixth embodiment, the parts the same as those in the fourth embodiment shown in FIG. 8 are referenced correspondingly to omit the overlapping description.

As shown in FIGS. 16 through 18, in the blanket drum supporter of the roller offset printing apparatus according to the sixth embodiment, roller linear guide rails 90*a* and 91*a* are formed at opposite end portions of the left and right stands 52 as shown in FIG. 16, and the respective lower end portions of the stands 52 are fixed to opposite side surfaces of the stage 4 by bolts.

Three bearings 90*b* are engaged with one linear guide rail 90*a* in each of the stands 52. Three bearings 91*b* are engaged with the other linear guide rail 91*a*. Although FIGS. 16 and 18 show the case where three bearings 90*b* are used, the number of bearings is not limited if the bearings can perform guiding between the left and right boxes 51 and the stands 52 so as to be moved up and down while rotated.

The three bearings 90*b* in each of the left and right sides are formed so as to be integrated with corresponding one of the left and right bearing accommodation boxes 51, and the three bearings 91*b* in each of the left and right sides are formed so as to be integrated with corresponding one of end plates 92 (see FIG. 18).

Side plates 93 and 94 are disposed at opposite side surfaces of each of the stands 52 so that the stands 52 are surrounded by the side plates 93 and 94, respective flange portions 51*a* of the boxes 51 and the end plates 92 (see FIG. 17).

The flange portions 51*a* are formed in the left and right boxes 51 respectively. One end of each of the flange portions 51*a* and the other end thereof are fixed to one end surface of the side plate 93 and one end surface of the side plate 94 by bolts 95 respectively (see FIGS. 16 and 17). The other end surface of the side plate 93 and the other end surface of the side plate 94 are fixed to one end of the end plate 92 and the other end of the end plate 92 by pre-loading bolts 96 respectively (see FIG. 17).

The pre-loading bolts 96 provide pre-loading to eliminate gaps between the left and right rails 90*a* and 91*a* and the left and right bearings 90*b* and 91*b*.

A support plate 97 is fixed to an upper end portion of each of the stands 52. An upper stopper bolt 98 for limiting the moving-up position of the roller transfer drum 1 is mounted to the support plate 97.

In the sixth embodiment having the aforementioned configuration, because the pre-loading bolts 96 provide pre-loading to eliminate gaps between the left and right rails 90*a* and 91*a* and the left and right bearings 90*b* and 91*b*, the roller transfer drum (blanket drum) 1 becomes stable in the directions of the axis and radius thereof when the transfer drum 1 is moved while rotated on the surface of the master plate 6 and the surface of the work plate not shown. As a result, patterns on the master plate 6 can be reproduced on the work plate accurately, so that printing accuracy can be improved.

Further, in the sixth embodiment, because a rectangular closed structure for surrounding each of the stands 52 is formed by the flange portion 51*a* of each of the left and right boxes 51, the end plate 92 and the two side plates 93 and 94, the stiffness of the whole structure for supporting the roller transfer drum 1 can be improved.

Further, in the sixth embodiment, because the left and right cylinders 53 are disposed so as to be lower than the axis of the roller transfer drum 1, reaction force produced when the outer circumferential surface of the rubber sheet 1*b* of the roller transfer drum 1 comes into contact with the surface of the master plate 6 or the surface of the work plate through a certain printing pressure does not act on the engagement portion. Accordingly, the transfer drum 1 is further prevented from becoming unstable in the directions of the axis and radius thereof. Further, the cylinders 53 can be mounted to the base 3 easily without interference with the roller transfer drum 1. Further, the cylinders 53 can be mounted to the base 3 with stiffness (prevention of vibration). Further, the cylinders can be mounted to the base 3 easily without provision of any special mounting member (for example, cylinder mounter) between the cylinders 53 and the base 3.

In the sixth embodiment, a pre-loading type linear guide may be used as the linear guide. In this case, it is unnecessary to use the pre-loading by the pre- loading bolts.

Although the fourth, fifth and sixth embodiments show the case where cylinders are used as actuators, it is a matter of course that the present is not limited thereto and that the invention can be applied to combinations of motors and feed screws are used as actuators.

As described above, in the roller offset printing apparatus according to the present invention, because positions of the master plate and the work plate placed on the linear stage are detected so that the respective positions of the master plate and the work plate are corrected in accordance with the quantities of displacement when there is any displacement between the detected positions and reference positions, accuracy in positioning of the master plate and the work plate can be improved so that good superposition printing can be performed.

Further, because driving is performed while the stage driving means and the roller transfer drum driving means are synchronized with each other, the roller transfer drum can be prevented from sliding. As a result, highly accurate printing can be realized.

According to the invention, the roller transfer drum together with the bearing accommodation box are driven relative to the stands in the vertical direction, so that the height of the rotational axis of the roller transfer drum can be adjusted so as to adjust the printing pressure. Further, a predetermined printing pressure can be obtained accurately and easily, in such a manner that a position of the box which relates to the height of the rotational axis of the roller transfer drum and relates to the required printing pressure is adjusted by the box position detecting means and the stopper. In addition, in the present invention, it is not necessary to provide a printing pressure adjustment shim is disposed between the iron roller and the rubber sheet, and it is also not necessary to disassemble the roller transfer drum when the shim is replaced with a new one.

According to the invention, the printing pressure can be adjusted by adjusting the height of the rotational axis of the roller transfer drum, and the predetermined magnitude of the printing pressure can be easily maintained by the pressure controlling means.

According to the invention, the rolling linear guide for guiding the vertical movement of the roller transfer drum and the linear bearing pre-loading mechanism for applying a pre-loading to said linear guide are used, so that the vertical movement of the roller transfer drum can be conducted in a low friction and simultaneously the vibration of the roller transfer drum in an axial direction and a radial direction thereof can be eliminated. The roller transfer drum can be prevented from becoming unstable in the directions of the axis and radius thereof, so that a printing accuracy can be improved.

According to the invention, the sagging of the elastic member provided on the outer periphery of the roller transfer drum, which influences the printing accuracy, can be automatically detected and alarmed without having a man's power.

According to the present invention, the sagging of the elastic member provided on the outer periphery of the roller transfer drum, which influences the printing accuracy, can be detected and inspected over the whole area.

According to the invention, the sagging of the elastic member provided on the outer periphery of the roller transfer drum can be corrected automatically.

While the present invention has been described above with several preferred embodiments thereof, it should of course be understood that the present invention should not be limited only to these embodiments but various change or modification may be made without departure from the scope of the present invention as defined by the appended claims.

What is claimed is:

1. A roller offset printing apparatus including:

a base (3);

a linear stage (4) movable forwards and backwards on said base (1);

a stage driving means (5) for driving said linear stage (4);

a roller transfer drum (1) for transferring a pattern image to be transferred while being rotated;

a roller transfer drum supporting means (16, 17) for rotatably supporting said roller transfer drum (1);

a master plate (6) and a work plate (7) disposed at a predetermined interval on said linear stage, said master plate (6) having ink pits formed in a surface of said master plate (6) for reserving ink; and a roller transfer drum driving means (2) for driving said roller transfer drum (1) so that said roller transfer drum (1) rotates on the surface of said master plate (6) to transfer the ink in said ink pits of said master plate (6) onto the outer circumferential surface of said roller transfer drum (1) and said roller transfer drum (1) further rotates on a surface of said work plate (7) to thereby transfer the ink from the outer circumferential surface of said roller transfer drum (1) onto the surface of said work plate (7), wherein said roller offset printing apparatus further comprising:

a synchronizing means (24) for driving said stage driving means (5) and said roller transfer drum driving means (2) under synchronization therebetween;

a position detection means (14, 15) for detecting positions of said master and work plates (6, 7) respectively; and a correction means (8, 9, 10, 11, 12, 13) for correcting the respective positions of said master and work plates (6, 7) in accordance with quantities of displacement of said master and work plates (6, 7) from reference positions respectively when the detected positions of said master and work plates (6, 7) displace from said reference positions respectively.

2. A roller offset printing apparatus according to claim 1, wherein said roller transfer drum supporting means includes a bearing member (50) for rotatably supporting the rotating axis of said roller transfer drum (1) and a printing pressure adjusting means for adjusting a printing pressure.

3. A roller offset printing apparatus according to claim 2, wherein said printing pressure adjusting means comprising:

a bearing accommodation box (51) for accommodating said bearing member (50);

a standing member (52) for slidably guiding and supporting said bearing accommodation box (51) upwardly and downwardly;

a box driving means (53) for driving said bearing accommodation box (51) upwardly and downwardly relative to said standing member (52);

a box position detecting means (55) for detecting a vertical position of said bearing accommodation box (51) relative to said standing member (52);

a stopper means (54) for limiting the descending position of said bearing accommodation box (51); and a box biasing means (56) for biasing said bearing accommodation box (51) upwardly so as to reduce the dead weight of the whole of said bearing accommodation box (51) and said roller transfer drum (1).

4. A roller offset printing apparatus according to claim 2, wherein said printing pressure adjusting means comprises:

a bearing accommodation box (51);

a standing member (52) for supporting said bearing accommodation box (51);

a box driving means (53) for driving said moving said bearing accommodation box (51);

a box biasing means; (56) for biasing said bearing accommodation box (51); and a roller transfer drum pressure detecting means for detecting a contact pressure of said roller transfer drum (1) relative to at least one of said master plate (6) and said work plate (7).

5. A roller offset printing apparatus according to claim 1, further comprising a bearing accommodation box and a standing member for supporting said bearing accommodation box, wherein said roller transfer drum supporting means comprises:

a rolling linear guiding means for slidably supporting and guiding said bearing accommodation box (51) upwardly and downwardly relative to said standing member (52); and a pre-loading applying means for applying a pre-loading to said rolling linear guiding means.

6. A roller offset printing apparatus according to claim 1, wherein said roller transfer drum supporting means comprises:

a sagging detecting means (73) for detecting a quantity of distance variation between said sagging detecting means (73) and the outer periphery of said roller transfer drum (1) along the axial direction of said roller transfer drum (1).

7. A roller offset printing apparatus according to claim 6, wherein said sagging detecting means (73) comprises a transporting means for moving said sagging detecting means (73) in the axial direction of said roller transfer drum (1).

8. A roller offset printing apparatus according to claim 1, in which said roller transfer drum comprises a core member and an elastic member covering the outer periphery of said core member, said roller offset printing apparatus further comprising:

a winding means for winding said elastic member relative onto said core member so as to apply a tension to said elastic member.

* * * * *